US011624987B2

(12) United States Patent
Tokunaga et al.

(10) Patent No.: US 11,624,987 B2
(45) Date of Patent: Apr. 11, 2023

(54) LIQUID DEVELOPER

(71) Applicant: CANON KABUSHIKI KAISHA, Tokyo (JP)

(72) Inventors: Yuzo Tokunaga, Chiba (JP); Takashi Hirasa, Moriya (JP); Yasutaka Akashi, Yokohama (JP); Masato Nakajima, Moriya (JP); Naohiko Tsuchida, Tokyo (JP); Akifumi Matsubara, Kashiwa (JP); Kohji Takenaka, Toride (JP); Yuya Chimoto, Funabashi (JP); Kouichirou Ochi, Chiba (JP); Tomoyo Miyakai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 117 days.

(21) Appl. No.: 17/020,253

(22) Filed: Sep. 14, 2020

(65) Prior Publication Data

US 2020/0409285 A1 Dec. 31, 2020

Related U.S. Application Data

(63) Continuation of application No. PCT/JP2019/010470, filed on Mar. 14, 2019.

(30) Foreign Application Priority Data

Mar. 16, 2018 (JP) ..... JP2018-049211

(51) Int. Cl.
*G03G 9/13* (2006.01)

(52) U.S. Cl.
CPC ..... *G03G 9/132* (2013.01)

(58) Field of Classification Search
CPC ..... G03G 9/132
See application file for complete search history.

(56) References Cited

U.S. PATENT DOCUMENTS

| | | | | |
|---|---|---|---|---|
| 4,904,562 | A | 2/1990 | Yusa et al. | |
| 5,212,524 | A | 5/1993 | Tanikawa et al. | |
| 5,215,854 | A | 6/1993 | Yamazaki et al. | |
| 5,268,248 | A | 12/1993 | Tanikawa et al. | |
| 5,296,326 | A | 3/1994 | Taya et al. | |
| 5,348,829 | A | 9/1994 | Uchiyama et al. | |
| 5,480,755 | A | 1/1996 | Uchiyama et al. | |
| 5,500,318 | A | 3/1996 | Tanikawa et al. | |
| 5,504,272 | A | 4/1996 | Uchiyama et al. | |
| 5,573,880 | A | 11/1996 | Mayama et al. | |
| 5,622,804 | A * | 4/1997 | Matsuoka | G03G 9/12 430/115 |
| 5,641,600 | A | 6/1997 | Kotaki et al. | |
| 5,712,069 | A | 1/1998 | Baba et al. | |
| 5,766,814 | A | 6/1998 | Baba et al. | |
| 6,083,655 | A | 7/2000 | Itabashi et al. | |
| 6,106,990 | A | 8/2000 | Tazawa et al. | |
| 6,159,648 | A | 12/2000 | Baba et al. | |
| 6,165,663 | A | 12/2000 | Baba et al. | |
| 6,566,028 | B2 | 5/2003 | Tazawa et al. | |
| 6,632,577 | B2 | 10/2003 | Akashi et al. | |
| 7,361,400 | B2 | 4/2008 | Shimamura et al. | |
| 7,361,442 | B2 | 4/2008 | Otake et al. | |
| 7,796,926 | B2 | 9/2010 | Matsuda et al. | |
| 7,833,687 | B2 | 11/2010 | Kato et al. | |
| 8,399,170 | B2 | 3/2013 | Iwase et al. | |
| 8,538,303 | B2 | 9/2013 | Matsuda et al. | |
| 8,697,327 | B2 | 4/2014 | Shibata et al. | |
| 9,057,970 | B2 | 6/2015 | Ida et al. | |
| 9,158,217 | B2 | 10/2015 | Takahashi et al. | |
| 9,348,247 | B2 | 5/2016 | Ida et al. | |
| 9,372,420 | B2 | 6/2016 | Mizo et al. | |
| 9,417,540 | B2 | 8/2016 | Hashimoto et al. | |
| 9,436,112 | B2 | 9/2016 | Iwasaki et al. | |
| 9,540,483 | B2 | 1/2017 | Ida et al. | |
| 9,568,849 | B2 | 2/2017 | Imai et al. | |
| 9,665,021 | B2 | 5/2017 | Ohtsu et al. | |
| 9,665,026 | B2 | 5/2017 | Iwasaki et al. | |
| 9,671,707 | B2 | 6/2017 | Minagawa et al. | |
| 9,696,644 | B2 | 7/2017 | Ida et al. | |
| 9,703,216 | B2 | 7/2017 | Tsuchida et al. | |
| 9,703,224 | B2 | 7/2017 | Yoshie | |
| 9,897,934 | B2 | 2/2018 | Tamura et al. | |
| 10,012,920 | B2 | 7/2018 | Shibata et al. | |
| 10,078,281 | B2 | 9/2018 | Ida et al. | |
| 10,088,765 | B2 | 10/2018 | Miyakai et al. | |
| 10,146,146 | B2 | 12/2018 | Komatsu et al. | |
| 10,175,595 | B2 | 1/2019 | Onozaki et al. | |
| 10,203,619 | B2 | 2/2019 | Yamashita et al. | |

(Continued)

FOREIGN PATENT DOCUMENTS

| | | |
|---|---|---|
| EP | 1884834 | 2/2008 |
| JP | 2001031900 A | 2/2001 |

(Continued)

OTHER PUBLICATIONS

U.S. Appl. No. 17/012,718, Naohiko Tsuchida, filed Sep. 4, 2020.
U.S. Appl. No. 17/020,223, Akifumi Matsubara, filed Sep. 14, 2020.

*Primary Examiner* — Peter L Vajda
*Assistant Examiner* — Boone Alexander Evans
(74) *Attorney, Agent, or Firm* — Venable LLP

(57) ABSTRACT

A liquid developer comprising: a toner particle containing binder resin; a carrier liquid; and a basic toner particle dispersing agent, wherein the basic toner particle dispersing agent is a primary amine, an acid value of the binder resin is at least 10 mg KOH/g, an acid value of a component having a molecular weight of not more than 2,000 contained in the binder resin is not more than 5 mg KOH/g, and a hydroxyl value of the component having a molecular weight of not more than 2,000 contained in the binder resin is not more than 10 mg KOH/g.

5 Claims, No Drawings

(56) References Cited

U.S. PATENT DOCUMENTS

| | | | | |
|---|---|---|---|---|
| 10,228,629 | B2 | 3/2019 | Tamura et al. | |
| 10,353,312 | B2 | 7/2019 | Kamae et al. | |
| 10,451,986 | B2 | 10/2019 | Sano et al. | |
| 10,451,990 | B2 | 10/2019 | Kamae et al. | |
| 10,474,049 | B2 | 11/2019 | Onozaki et al. | |
| 10,514,624 | B2 | 12/2019 | Tamura et al. | |
| 2009/0123187 | A1 | 5/2009 | Teshima et al. | |
| 2009/0233214 | A1* | 9/2009 | Hiraga | G03G 15/10 430/114 |
| 2009/0233215 | A1 | 9/2009 | Ueno et al. | |
| 2009/0253066 | A1 | 10/2009 | Yamada | |
| 2010/0136474 | A1 | 6/2010 | Iwase et al. | |
| 2013/0108955 | A1 | 5/2013 | Shibata et al. | |
| 2013/0202998 | A1 | 8/2013 | Higashi et al. | |
| 2014/0004460 | A1 | 1/2014 | Yoshiba et al. | |
| 2014/0137428 | A1 | 5/2014 | Takenaka et al. | |
| 2015/0056549 | A1* | 2/2015 | Ikeda | G03G 9/08711 430/108.22 |
| 2015/0099227 | A1 | 4/2015 | Ida et al. | |
| 2015/0220013 | A1 | 8/2015 | Nishikawa et al. | |
| 2016/0085171 | A1* | 3/2016 | Yoshie | G03G 9/132 430/114 |
| 2016/0159976 | A1* | 6/2016 | Ono | C08G 63/46 528/193 |
| 2016/0195827 | A1* | 7/2016 | Murayama | G03G 15/0126 430/105 |
| 2016/0202626 | A1 | 7/2016 | Imai et al. | |
| 2017/0010555 | A1 | 1/2017 | Iwase et al. | |
| 2017/0315463 | A1 | 11/2017 | Onozaki et al. | |
| 2018/0046102 | A1 | 2/2018 | Tsuchida et al. | |
| 2018/0181017 | A1 | 6/2018 | Kamiyoshi et al. | |
| 2018/0307153 | A1 | 10/2018 | Kanno et al. | |
| 2018/0314176 | A1 | 11/2018 | Ikeda et al. | |
| 2018/0321607 | A1 | 11/2018 | Matsubara et al. | |
| 2018/0329333 | A1 | 11/2018 | Tokunaga et al. | |
| 2018/0348658 | A1 | 12/2018 | Tsuchida et al. | |
| 2019/0107794 | A1 | 4/2019 | Tokunaga et al. | |
| 2020/0272068 | A1 | 8/2020 | Ochi et al. | |
| 2020/0301301 | A1 | 9/2020 | Chimoto et al. | |
| 2020/0310273 | A1 | 10/2020 | Chimoto et al. | |
| 2020/0341396 | A1 | 10/2020 | Ochi et al. | |
| 2020/0409285 | A1 | 12/2020 | Tokunaga et al. | |

FOREIGN PATENT DOCUMENTS

| | | | | |
|---|---|---|---|---|
| JP | 2003241439 | A | 8/2003 | |
| JP | 2009122281 | A | 6/2009 | |
| JP | 2009244834 | A | 10/2009 | |
| JP | 2009251086 | A | 10/2009 | |
| JP | 2011158791 | A | 8/2011 | |
| JP | 2016061964 | A | 4/2016 | |
| JP | 2016080764 | A | 5/2016 | |
| JP | 2016080837 | A | 5/2016 | |
| JP | 2016128864 | A | 7/2016 | |
| JP | 2016142846 | A | 8/2016 | |
| JP | 2016224103 | A | 12/2016 | |
| JP | 2017111460 | A | 6/2017 | |
| JP | 2017198832 | A | 11/2017 | |
| JP | 2017223791 | A | 12/2017 | |
| WO | 2006126566 | A1 | 11/2006 | |
| WO | 2007000974 | A1 | 1/2007 | |
| WO | 2007000975 | A1 | 1/2007 | |
| WO | 2007108485 | A1 | 9/2009 | |
| WO | 2015119145 | A1 | 8/2015 | |
| WO | WO-2016103582 | A1 * | 6/2016 | C01B 33/40 |
| WO | 2018097090 | A1 | 5/2018 | |
| WO | 2019177083 | A1 | 9/2019 | |
| WO | 2019177136 | A1 | 9/2019 | |

* cited by examiner

LIQUID DEVELOPER

CROSS-REFERENCE TO RELATED APPLICATIONS

This application is a Continuation of International Patent Application No. PCT/JP2019/010470, filed Mar. 14, 2019, which claims the benefits of Japanese Patent Application No. 2018-049211, filed Mar. 16, 2018, both of which are hereby incorporated by reference herein in their entirety.

BACKGROUND OF THE INVENTION

Field of the Invention

The present invention relates to a liquid developer that is used in image-forming apparatuses that employ an electrophotographic system, e.g., electrophotography, electrostatic recording, and electrostatic printing.

Background Art

There has been an increase in recent years in the demands imposed by colorization on image-forming apparatuses that utilize electrophotographic systems, e.g., copiers, facsimile machines, and printers.

Within this context, there is increasing activity with regard to the development of high-image-quality, high-speed digital printers that utilize electrophotographic technology and use liquid developers, which exhibit an excellent ability to reproduce fine-line images, an excellent gradation reproducibility, an excellent color reproducibility, and an excellent capacity for high-speed image formation. In view of these circumstances, the development is required of liquid developers that have even better properties.

Dispersions of toner particles, i.e., colored resin particles, in a carrier liquid comprising an insulating liquid, e.g., a hydrocarbon organic solvent or silicone oil, are already known as liquid developers.

For example, PTL 1 discloses an increase in the toner particle dispersion stability by using an acid group-bearing resin having an acid value of 20 mg KOH/g as a binder resin constituting the toner particle and using a basic dispersing agent having an amine value of at least 5 mg KOH/g as a toner particle dispersing agent.

CITATION LIST

Patent Literature

PTL 1 WO 2015/119145

However, when a basic toner particle dispersing agent such as the above is used, the volume resistivity of the liquid developer declines during storage of the liquid developer. This has resulted in a decline in the toner particle migration performance and a reduction in image quality.

The present invention provides a liquid developer that exhibits an excellent toner particle dispersion stability and a suppression of the reduction in volume resistivity due to elapsed time.

SUMMARY OF THE INVENTION

The present invention is a liquid developer comprising: a toner particle containing binder resin; a carrier liquid; and a basic toner particle dispersing agent, wherein the basic toner particle dispersing agent is a primary amine, an acid value of the binder resin is at least 10 mg KOH/g, an acid value of a component having a molecular weight of not more than 2,000 contained in the binder resin is not more than 5 mg KOH/g, and a hydroxyl value of the component having a molecular weight of not more than 2,000 contained in the binder resin is not more than 10 mg KOH/g.

It was found that the problem associated with the use of the aforementioned basic toner particle dispersing agent is caused by the release into the carrier liquid of the toner particle dispersing agent and a low-molecular-weight component of the binder resin in a bonded state.

That is, with the elapse of time, a low-molecular-weight component of the binder resin elutes into the carrier liquid from the toner particle, and, because basic toner particle dispersing agent is present bonded to this low-molecular-weight binder resin, the volume resistivity of the carrier liquid then declines.

This impedes the action of the electric field in the carrier liquid in the electrophotographic process. As a result, the toner particle migration performance is reduced, the electrostatic latent image on the surface of the photosensitive member is disturbed, and the image quality is reduced.

In response to this, a solution to the aforementioned problem was achieved through the use of a liquid developer having the following characteristics.

An acid value of the binder resin is at least 10 mg KOH/g,

An acid value of a component having a molecular weight of not more than 2,000 contained in the binder resin is not more than 5 mg KOH/g, and A hydroxyl value of the component having a molecular weight of not more than 2,000 contained in the binder resin is not more than 10 mg KOH/g.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

In addition, monomer unit refers to the reacted form of a monomer material in the polymer or resin.

The present invention is a liquid developer comprising: a toner particle containing binder resin; a carrier liquid; and a basic toner particle dispersing agent, wherein the basic toner particle dispersing agent is a primary amine, an acid value of the binder resin is at least 10 mg KOH/g, an acid value of a component having a molecular weight of not more than 2,000 contained in the binder resin is not more than 5 mg KOH/g, and a hydroxyl value of the component having a molecular weight of not more than 2,000 contained in the binder resin is not more than 10 mg KOH/g.

The component having a molecular weight of not more than 2,000 that is contained in the binder resin readily elutes into the carrier liquid with elapsed time.

When this eluted component has a high acid value or hydroxyl value, the eluted component and basic toner particle dispersing agent, bonded to each other through ionic bonding or hydrogen bonding, are released into the carrier liquid, causing a decline in the volume resistivity.

Even when elution of this component does occur, release accompanied by the basic toner particle dispersing agent does not occur when the acid value of this component is not more than 5 mg KOH/g. The lower limit is not particularly limited, but is equal to or greater than 0 mg KOH/g.

The acid value of the component having a molecular weight of not more than 2,000 that is contained in the binder resin is preferably not more than 3 mg KOH/g and is more preferably 0 mg KOH/g.

Similarly, when the hydroxyl value of this component is not more than 10 mg KOH/g, release accompanied by the basic toner particle dispersing agent does not occur, even when elution of this component does occur. The lower limit is not particularly limited, but is equal to or greater than 0 mg KOH/g.

The hydroxyl value of the component having a molecular weight of not more than 2,000 that is contained in the binder resin is preferably not more than 5 mg KOH/g and is more preferably 0 mg KOH/g.

When the acid value of the binder resin is at least 10 mg KOH/g, and the basic toner particle dispersing agent is a primary amine, the basic toner particle dispersing agent is then retained on the toner particle surface by ionic bonding.

The acid value of the binder resin is preferably at least 13 mg KOH/g. The upper limit on the acid value of the binder resin is not particularly limited, but is preferably not more than 50 mg KOH/g and more preferably not more than 40 mg KOH/g.

Any combination of these numerical value ranges can be used.

The acid value of the component having a molecular weight of from 10,000 to 40,000 that is contained in the binder resin is preferably at least 15 mg KOH/g, more preferably at least 17 mg KOH/g, and still more preferably at least 19 mg KOH/g. The upper limit on this acid value is not particularly limited, but is preferably not more than 50 mg KOH/g and more preferably not more than 40 mg KOH/g.

Any combination of these numerical value ranges can be used.

The component having a molecular weight of from 10,000 to 40,000 that is contained in the binder resin is resistant to elution from the toner particle.

When the acid value of this high-molecular-weight resin component is at least 15 mg KOH/g, the toner particle dispersing agent, which is a primary amine, tightly bonds with resin-derived acid groups at the toner particle surface and the occurrence of the problem of release of the toner particle dispersing agent is suppressed.

The resin constituting the binder resin should contain resin that can provide an acid value of at least 10 mg KOH/g, but is not otherwise particularly limited and known resins can be used.

In addition, the binder resin is preferably insoluble in the carrier liquid.

The metric here for insoluble in the carrier liquid is that not more than 1 mass parts of the binder resin dissolves in 100 mass parts of the carrier liquid at a temperature of 25° C.

The resin constituting the binder resin can be exemplified by the following resins:

homopolymers of styrene and its substituted forms, e.g., polystyrene, poly-p-chlorostyrene, and polyvinyltoluene;

styrene copolymers, e.g., styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, and styrene-vinyl methyl ketone copolymers; as well as polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyvinyl butyral resins, terpene resins, coumarone-indene resins, and petroleum resins.

Among the preceding, polyester resins, styrene-acrylate ester copolymers, styrene-methacrylate ester copolymers, and so forth are preferred from the standpoint of the interaction with the toner particle dispersing agent. Polyester resins are more preferred.

This polyester resin is preferably the condensation polymer of an alcohol with a carboxylic acid.

This alcohol can be exemplified by the following:

alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid can be exemplified by the following:

aromatic dicarboxylic acids such as phthalic acid, isophthalic acid, and terephthalic acid and their anhydrides; alkyl dicarboxylic acids such as succinic acid, adipic acid, sebacic acid, and azelaic acid and their anhydrides; succinic acid substituted by an alkyl group or alkenyl group having 6 to 18 carbons, and anhydrides thereof; unsaturated dicarboxylic acids such as fumaric acid, maleic acid, and citraconic acid and their anhydrides.

In addition, the following monomers may also be used in addition to the preceding:

polyhydric alcohols such as sorbitol, sorbitan, and the oxyalkylene ethers of novolac-type phenolic resins; and polybasic carboxylic acids such as trimellitic acid, pyromellitic acid, benzophenonetetracarboxylic acid, and their anhydrides.

The resin that can provide an acid value of at least 10 mg KOH/g can be prepared by the optimization of a heretofore known method, i.e., the polymerization time, the polymerization temperature, the timing of monomer material mixing, the selection of and blending ratio for the monomer materials, and so forth.

The following is an example of a method for efficiently preparing a binder resin for which the acid value is at least 10 mg KOH/g, the acid value of the component having a molecular weight of not more than 2,000 that is contained in the binder resin is not more than 5 mg KOH/g, and the hydroxyl value of the component having a molecular weight of not more than 2,000 that is contained in the binder resin is not more than 10 mg KOH/g:

mixing a high-molecular-weight resin A having a weight-average molecular weight (Mw) of preferably from 12,000 to 60,000 (more preferably from 15,000 to 40,000) and having an acid value of preferably at least 15 mg KOH/g (more preferably from 15 mg KOH/g to 40 mg KOH/g), with a resin B having a weight-average molecular weight (Mw) of preferably 1,000 to 12,000 (more preferably from 4,000 to 10,000) and having an acid value of not more than 5 mg KOH/g and a hydroxyl value of not more than 10 mg KOH/g.

Here, viewed from the standpoint of the fixing performance of the liquid developer, the weight-average molecular weight (Mw) of the binder resin is preferably from 8,000 to 55,000 and is more preferably from 10,000 to 50,000.

In addition, the softening point (Tm) of resin A is preferably from 100° C. to 120° C. and is more preferably from 100° C. to 115° C.

The softening point (Tm) of resin B, on the other hand, is preferably from 80° C. to 110° C. and is more preferably from 85° C. to 105° C.

In addition, the acid value of resin B is preferably not more than 5 mg KOH/g and more preferably not more than 3 mg KOH/g and still more preferably is 0 mg KOH/g.

The hydroxyl value of resin B is preferably not more than 10 mg KOH/g and more preferably not more than 5 mg KOH/g and still more preferably is 0 mg KOH/g.

With regard to the mass ratio between resin A and resin B, this is not particularly limited as long as the weight-average molecular weight of the binder resin is from 8,000 to 55,000, but (resin A:resin B) is preferably from 8:2 to 1:9 and is more preferably from 7:3 to 3:7.

An even higher fixing performance can be obtained by having the mass ratio between resin A and resin B be in the indicated range.

The following method is an example of a method for conveniently producing resin B.

When the resin B is a polyester resin, at least one monomer unit selected from the group consisting of monomer units derived from aliphatic monocarboxylic acids having from 1 to 6 carbons (preferably from 2 to 5 carbons) and aromatic monocarboxylic acids having from 7 to 12 carbons (preferably from 7 to 11 carbons) may be placed at the molecular terminal position of resin B.

These monocarboxylic acid-derived monomer units are the structures provided by removing the hydroxyl group from the carboxy group in the monocarboxylic acid.

In addition, when the polyester resin has a branch chain, the "molecular chain terminal position" also includes the terminal position for the branch chain.

More specifically, a monocarboxylic acid, for example, acetic acid, propionic acid, butyric acid, benzoic acid, and so forth, may be reacted at the end of the polymerization reaction and condensed with the hydroxyl groups in resin B. The use of this method makes it possible to effectively produce a resin having a low hydroxyl value and to do so without increasing the acid value.

This basic toner particle dispersing agent can bring about the stable dispersion of toner particles in the carrier liquid. The dispersion stability of the toner particles is enhanced through the use of the binder resin and this basic toner particle dispersing agent.

This basic toner particle dispersing agent is a primary amine.

The amino group (—$NH_2$) present in the primary amine bonds tightly to the resin-derived acid groups at the toner particle surface, and a substantial increase in the toner particle dispersion stability is then brought about by the basic toner particle dispersing agent while release of the basic toner particle dispersing agent is suppressed at the same time.

The amine value of this toner particle dispersing agent is preferably from 10 mg KOH/g to 200 mg KOH/g and is more preferably from 20 mg KOH/g to 100 mg KOH/g.

By having the amine value of this toner particle dispersing agent satisfy the aforementioned range, a more substantial interaction with the binder resin is established and dissolution of the toner particle dispersing agent into the carrier liquid is further suppressed.

The toner particle dispersing agent may dissolve or may disperse in the carrier liquid.

Specific examples of this basic toner particle dispersing agent are provided in the following, but this should not be understood as a limitation thereto or thereby.

Examples within the sphere of commercial products are Ajisper PB-817 (primary amine: reaction product of a polyallylamine with a self-condensate of 12-hydroxystearic acid, Ajinomoto Fine-Techno Co., Inc.) and Solsperse 11200, 13940, 17000, and 18000 (Lubrizol Japan Ltd.).

The basic toner particle dispersing agent is more preferably an amino group-bearing polymer that has the amino group in a position other than terminal position on the polymer main chain, such as Ajisper PB-817.

From the standpoint of the dispersion stability, the content of the basic toner particle dispersing agent in the liquid developer is preferably from 0.5 mass parts to 20.0 mass parts per 100 mass parts of the toner particle.

A single such basic toner particle dispersing agent may be used by itself or two or more may be used in combination.

The carrier liquid should be a liquid that is nonvolatile at normal temperature and that exhibits a high volume resistivity, an electrical insulating behavior, and a low viscosity at around room temperature, but is not otherwise particularly limited.

The carrier liquid can be exemplified by aliphatic hydrocarbons, alicyclic hydrocarbons, aromatic hydrocarbons, halogenated hydrocarbons, polysiloxanes, silicone oils, animal and plant oils, mineral oils, and so forth.

Normal-paraffin solvents and isoparaffin solvents are preferred from the standpoints of odor, lack of toxicity, and cost.

Examples at a more specific level are Moresco White P40 (trade name), Moresco White P60 (trade name), and Moresco White P120 (trade name), from the MORESCO Corporation; Isopar (trade name, ExxonMobil Chemical); Shellsol 71 (trade name, Shell Petrochemicals Co., Ltd.); and IP Solvent 1620 (trade name, Idemitsu Petrochemical Co., Ltd.) and IP Solvent 2028 (trade name, Idemitsu Petrochemical Co., Ltd.).

An electrically insulating carrier liquid that is nonvolatile at normal temperature, and that is at the same time a curable carrier liquid that does not impart fixability to the toner particle, may also be used.

In the case of use of a curable carrier liquid, the carrier liquid can be selected from polymerizable liquid monomers. The polymerizable liquid monomer can be exemplified by acrylic monomers, vinyl ether compounds, and cyclic ether monomers such as epoxides and oxetanes.

In order to avoid dissolution of the binder resin component with elapsed time, the difference between the SP value (solubility parameter) of the carrier liquid and the SP value of the binder resin constituting the toner particle is preferably at least 2.5. The SP value is defined and its method of calculation is described in, for example, "IUPAC Gold Book—solubility parameter, δ".

The toner particle may contain a colorant.

There are no particular limitations on this colorant, and any generally commercially available organic pigment and inorganic pigment can be used, as can a pigment dispersed in, for example, an insoluble resin as a dispersion medium, as well as pigments provided by grafting a resin onto the pigment surface.

Specific examples of the pigment are provided in the following, but this should not be understood as a limitation thereto or thereby.

The following are specific examples of organic pigments and inorganic pigments that exhibit a yellow color:

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C.I. Vat Yellow 1, 3, and 20.

The following are examples of pigments that exhibit a red or magenta color:

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C.I. Pigment Violet 19; and C.I. Vat Red 1, 2, 10, 13, 15, 23, 29, and 35.

The following are examples of pigments that exhibit a blue or cyan color:

C.I. Pigment Blue 2, 3, 15:2, 15:3, 15:4, 16, and 17; C.I. Vat Blue 6; C.I. Acid Blue 45; and copper phthalocyanine pigments in which 1 to 5 phthalimidomethyl groups are substituted on the phthalocyanine skeleton.

The following are examples of pigments that exhibit a green color:

C.I. Pigment Green 7, 8, and 36.

The following are examples of pigments that exhibit an orange color:

C.I. Pigment Orange 66 and 51.

The following are examples of pigments that exhibit a black color:

Carbon black, titanium black, and aniline black.

Specific examples of white pigments are as follows:

Basic lead carbonate, zinc oxide, titanium oxide, and strontium titanate.

The content of the colorant, per 100 mass parts of the resin component in the toner particle, is preferably from 5 mass parts to 100 mass parts, more preferably from 10 mass parts to 80 mass parts, and still more preferably from 15 mass parts to 50 mass parts.

A disperser, as exemplified by the following, may be used to disperse the pigment:

Ball mill, sand mill, attritor, roll mill, jet mill, homogenizer, paint shaker, kneader, agitator, Henschel mixer, colloid mill, ultrasound homogenizer, pearl mill, and wet jet mill.

A pigment dispersing agent and/or a pigment dispersion auxiliary may also be used when pigment dispersion is carried out.

This pigment dispersing agent and pigment dispersion auxiliary can be exemplified by the esters of hydroxyl group-bearing carboxylic acids, the salts of high-molecular-weight acid esters and long-chain polyaminoamides, the salts of high-molecular-weight polycarboxylic acids, esters of high-molecular-weight unsaturated acids, high-molecular-weight copolymers, polyesters and modifications thereof, modified polyacrylates, aliphatic polybasic carboxylic acids, naphthalenesulfonic acid/formalin condensates, polyoxyethylenealkyl phosphate esters, and pigment derivatives.

Also usable are commercial pigment dispersing agents such as the Solsperse series from Lubrizol Japan Ltd. and the Vylon (registered trademark) UR series from Toyobo Co., Ltd. A synergist corresponding to the particular pigment may also be used.

The amount of addition of these pigment dispersing agents and pigment dispersion auxiliaries is preferably from 1 mass parts to 100 mass parts per 100 mass parts of the pigment.

The method for adding the pigment dispersing agent and pigment dispersion auxiliary is not particularly limited, but addition in a pigment dispersion step is preferred from the standpoint of the pigment dispersibility.

The liquid developer may as necessary contain a charge control agent. Known charge control agents can be used as this charge control agent.

Specific compounds are, for example, fats and oils such as linseed oil and soybean oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexanoate; sulfonate metal salts such as metal petroleum sulfonates and metal salts of sulfosuccinate esters; phospholipids such as hydrogenated lecithin and lecithin; metal salicylate salts such as metal complexes of t-butylsalicylic acid; as well as polyvinylpyrrolidone resins, polyamide resins, sulfonic acid-containing resins, and hydroxybenzoic acid derivatives.

Besides the preceding, suitable selections from various known additives, for example, surfactants, lubricants, fillers, defoamants, ultraviolet absorbers, oxidation inhibitors, antifading agents, antimolds, rust inhibitors, and so forth, may be used on an optional basis in the liquid developer with the goals of improving the recording medium compatibility, storage stability, image storability, and other properties.

The liquid developer can be advantageously used in ordinary or common image-forming apparatuses that employ an electrophotographic system.

There are no particular limitations on the method for producing the liquid developer, and known methods, e.g., a coacervation method, wet pulverization method, and so forth, can be used.

The details of the coacervation method are described in, for example, Japanese Patent Application Laid-open No. 2003-241439, WO 2007/000974, and WO 2007/000975.

In the coacervation method, a binder resin, basic toner particle dispersing agent, solvent that dissolves the binder resin, and solvent that does not dissolve the binder resin are intermixed, and the solvent that dissolves the binder resin is then removed from the resulting mixture, causing the precipitation of the binder resin, which had been in a dissolved state, and resulting in the dispersion of toner particles in the solvent that does not dissolve the binder resin.

For example, a favorable example of the production method comprises:

a pigment dispersion step of preparing a pigment dispersion that contains a binder resin, pigment, basic toner particle dispersing agent, and solvent that dissolves the binder resin;

a mixing step of adding, to the pigment dispersion, a solvent that does not dissolve the binder resin and preparing a mixture; and a distillative removal step of distillatively removing, from the mixture, the solvent that dissolves the binder resin.

On the other hand, the details of the wet pulverization method are described in, for example, WO 2006/126566 and WO 2007/108485.

In this wet pulverization method, the binder resin and other additives are kneaded at or above the melting point of the resin; this is followed by dry pulverization; and the resulting pulverizate is wet-pulverized in the carrier liquid to bring about dispersion of the toner particles in the carrier liquid.

From the standpoint of obtaining a high-definition image, the 50% particle diameter on a volume basis (D50) of the toner particle is preferably from 0.10 μm to 5.00 μm and is more preferably from 0.10 μm to 2.00 μm.

The particle size distribution of the toner particle (95% particle diameter on a volume basis (D95)/50% particle diameter on a volume basis (D50)) is preferably not more than 5, more preferably not more than 3, and still more preferably not more than 2 and particularly preferably is 1.

Having the D50 and particle size distribution be in the indicated ranges makes it possible to bring about both an excellent developing performance and a satisfactorily thin film thickness for the toner image.

The toner particle concentration in the liquid developer can be freely adjusted in accordance with the image-forming apparatus that is used, but may be approximately from 1 mass % to 70 mass %.

The methods used to measure the properties pertaining to the present invention are described in the following.

<Structural Analysis of the Binder Resin in the Toner Particle>

The toner particle is separated from the liquid developer by centrifugal separation and washing.

Specifically, 50 mL of the liquid developer is introduced into a centrifuge tube and centrifugal separation is carried out using a centrifugal separator (Allegra 64R Centrifuge, Beckman Coulter, Inc.) and conditions of 15,000 rpm and 10 minutes.

Toner particle sedimentation is confirmed; the supernatant is removed by decantation; and hexane is added in the same amount as the supernatant that has been removed. A thorough washing by the hexane is performed by stirring for 5 minutes with a spatula, and centrifugal separation is subsequently carried out again using the same conditions. After hexane has been added and removed three times, the hexane is evaporated at room temperature to obtain the toner particle.

Compositional analysis of the binder resin constituting the toner particle is carried out by measuring the $^{1}$H-NMR and $^{13}$C-NMR spectra of the obtained toner particles using an ECA-400 (400 MHz) from JEOL Ltd.

The measurement is run at 25° C. in a deuterated solvent containing tetramethylsilane as the internal reference substance.

<Method for Measuring the Weight-Average Molecular Weight (Mw) of, e.g., the Binder Resin>

The weight-average molecular weight (Mw) of the, e.g., binder resin, is determined as polystyrene using gel permeation chromatography (GPC). The method for measuring the weight-average molecular weight (Mw) using GPC is described in the following.

Sample sufficient to provide a sample concentration of 1.0 mass % is added to the eluent indicated below, and a solution in which the sample is dissolved is prepared by standing for 24 hours at room temperature. This solution is filtered across a solvent-resistant membrane filter having a pore diameter of 0.20 μm to provide the sample solution, and the measurement is run using the following conditions.

Instrument: "HLC-8220GPC" high-performance GPC instrument [Tosoh Corporation]

Column: 2×LF-804

Eluent: tetrahydrofuran (THF)

Flow rate: 1.0 mL/min

Oven temperature: 40° C.

Sample injection amount: 0.025 mL

A molecular weight calibration curve constructed using polystyrene resin standards [Tosoh Corporation, TSK Standard Polystyrene F-850, F-450, F-288, F-128, F-80, F-40, F-20, F-10, F-4, F-2, F-1, A-5000, A-2500, A-1000, A-500] is used to determine the molecular weight of the sample.

<Method for Separating the Component Having a Molecular Weight of not More than 2,000 Contained in the Binder Resin and the Component Having a Molecular Weight from 10,000 to 40,000 Contained in the Binder Resin>

The following method is used to separate the component having a molecular weight of not more than 2,000 that is contained in the binder resin and the component having a molecular weight from 10,000 to 40,000 that is contained in the binder resin.

The toner particle is separated from the liquid developer using the method described above under Structural Analysis.

The separated toner particles are dissolved in tetrahydrofuran, and the soluble component of the toner particle is obtained by the reduced-pressure distillative removal of the tetrahydrofuran from the obtained soluble component.

The resulting toner particle soluble component is dissolved in chloroform; this is introduced into the instrument indicated below; and the fraction having a molecular weight of not more than 2,000 and the fraction having a molecular weight from 10,000 to 40,000 are respectively collected. The solvent is distilled from the collected fractions under reduced pressure to obtain the component having a molecular weight of not more than 2,000 that is contained in the binder resin and the component having a molecular weight from 10,000 to 40,000 that is contained in the binder resin.

instrument: preparative GPC Model LC-980 [Japan Analytical Industry Co., Ltd.]

column: JAIGEL 3H, JAIGEL 5H [Japan Analytical Industry Co., Ltd.]

The acid value and hydroxyl value of each of the obtained components are measured using the following method.

<Method for Measuring the Acid Value>

The basic procedure for measuring the acid value is based on JIS K 0070.

The determination is specifically carried out using the following method.

1) 0.5 to 2.0 g of the sample is exactly weighed. This mass is designated M1 (g).

2) The sample is introduced into a 50-mL beaker, 25 mL of a tetrahydrofuran/ethanol (2/1) mixed solvent is added, and dissolution is carried out.

3) Titration is performed using a 0.1 mol/L ethanolic KOH solution and a potentiometric titrator ("COM-2500" Automatic Titrator from Hiranuma Sangyo Co., Ltd.).

4) The amount of the KOH solution used here is designated S1 (mL). The blank is measured at the same time, and the amount of KOH used in this case is designated B1 (mL).

5) The acid value is calculated using the following formula. Here, f is the factor for the KOH solution.

$$\text{acid value [mg KOH/g]}=(S1-B1)\times f\times 5.61/M1$$

<Method for Measuring the Hydroxyl Value>

The basic procedure for measuring the hydroxyl value is based on JIS K 0070-1992.

The determination is specifically carried out using the following method.

1) 25 g of special-grade acetic anhydride is introduced into a 100-mL volumetric flask; the total volume is brought to 100 mL by the addition of pyridine; and an acetylation reagent is then provided by thorough shaking.

The obtained acetylation reagent is stored in a brown bottle isolated from contact with, e.g., humidity, carbon dioxide, and so forth.

2) 0.5 to 2.0 g of the sample is exactly weighed. This mass is designated M2 (g).

3) The sample is introduced into a 50-mL beaker, 25 mL of a tetrahydrofuran/ethanol (2/1) mixed solvent is added, and dissolution is carried out.

4) 5.0 mL of the aforementioned acetylation reagent is precisely added to this using a volumetric pipette. A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

5) After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath.

6) Titration is performed using a 0.1 mol/L ethanolic KOH solution and a potentiometric titrator ("COM-2500" Automatic Titrator from Hiranuma Sangyo Co., Ltd.).

The amount consumed by titration at this time is designated C (mL). The blank is measured at the same time, and the amount of KOH used in this case is designated D (mL).

7) The hydroxyl value is calculated by substituting the obtained results into the following formula.

$$\text{hydroxyl value [mg KOH/g]}=[(D-C)\times 28.05\times f/M2]+\text{acid value [mg KOH/g]}$$

<Method for Measuring 50% Particle Diameter (D50) on a Volume Basis of the Toner Particle>

The 50% particle diameter (D50) on a volume basis of the toner particle is measured using a laser diffraction/scattering particle size distribution analyzer (LA-950, Horiba, Ltd.).

<Method for Measuring the Softening Point (Tm)>

The softening point of, e.g., the resin, is measured using a "Flowtester CFT-500D Flow Property Evaluation Instrument" (Shimadzu Corporation), which is a constant-load extrusion-type capillary rheometer, in accordance with the manual provided with the instrument.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between S max, which is the piston stroke at the completion of outflow, and S min, which is the piston stroke at the start of outflow, is determined (this value is designated as X, where X=(S max−S min)/2). The temperature of the flow curve when the piston stroke in the flow curve reaches the sum of X and S min is the melting temperature by the ½ method.

The measurement sample used is prepared by subjecting 1.0 g of the resin to compression molding for approximately 60 seconds at approximately 10 MPa in a 25° C. environment using a tablet compression molder (NT-100H, NPa System Co., Ltd.) to provide a cylindrical shape with a diameter of approximately 8 mm.

The measurement conditions with the CFT-500D are as follows.

test mode: ramp-up method start temperature: 30° C.

saturated temperature: 200° C.

measurement interval: 1.0° C.

ramp rate: 4.0° C./min piston cross section area: 1.000 $cm^2$ test load (piston load): 10.0 kgf (0.9807 MPa)

preheating time: 300 seconds diameter of die orifice: 1.0 mm die length: 1.0 mm

<Method for Measuring the Glass Transition Temperature (Tg)>

The glass transition temperature of, e.g., the resins, is measured using a Q2000 (TA Instruments, Inc.) differential scanning calorimeter (DSC) and using the following conditions.

ramp rate: 10° C./min measurement start temperature: 20° C.

measurement end temperature: 180° C.

The melting points of indium and zinc are used for temperature correction in the instrument detection section, and the heat of fusion of indium is used for correction of the amount of heat.

Specifically, approximately 5 mg of the sample is exactly weighed out and introduced into an aluminum pan and differential scanning calorimetric measurement is carried out. An empty aluminum pan is used for reference.

Using the reversing heat flow curve during heating yielded by this differential scanning calorimetric measurement, the glass transition temperature (Tg, unit: ° C.) is taken to be the temperature at the point of intersection between the straight line that is equidistant in the vertical axis direction from the straight lines that extend the baselines for before the appearance and after the appearance of the change in specific heat, and the curve segment for the stepwise change at the glass transition in the reversing heat flow curve.

EXAMPLES

The present invention is described in detail in the following using examples, but the present invention is not limited to or by these examples. Unless specifically indicated otherwise, "parts" and "%" denote "mass parts" and "mass %".

The binder resins shown in Table 1-1 and Table 1-2 were used.

TABLE 1-1

| Binder resin | Polyester resin composition: molar ratio | | | | | | | | Properties | | | | |
|---|---|---|---|---|---|---|---|---|---|---|---|---|---|
| No. | BPA-EO | BPA-PO | EG | NPG | TPA | IPA | TMLA | BA | Tg | Tm | AV | OHV | Mw |
| 1 | 2 | — | 4 | 4 | 9 | — | 1 | — | 59 | 105 | 23 | 10 | 25000 |
| 2 | 2 | — | 4 | 4 | 5 | 5 | — | 0.9 | 57 | 100 | 0 | 1 | 8000 |
| 3 | 2 | — | 4 | 4 | 5 | 5 | — | — | 58 | 110 | 15 | 8 | 18000 |
| 4 | 2 | — | 4 | 4 | 5 | 5 | — | 0.8 | 57 | 100 | 1 | 1 | 8000 |
| 5 | 2 | — | 4 | 4 | 5 | 5 | — | — | 59 | 104 | 11 | 10 | 20000 |
| 6 | 2 | — | 4 | 4 | 5 | 5 | — | 0.8 | 57 | 100 | 5 | 1 | 8000 |
| 7 | 2 | — | 4 | 4 | 5 | 5 | — | — | 57 | 102 | 5 | 10 | 8000 |
| 8 | 2 | — | 4 | 4 | 5 | 5 | — | — | 61 | 106 | 14 | 9 | 22000 |
| 11 | 2 | — | 4 | 4 | 5 | 5 | — | — | 63 | 104 | 9 | 15 | 22000 |
| 12 | 2 | — | 4 | 4 | 5 | 5 | — | 0.9 | 57 | 100 | 4 | 1 | 8000 |
| 13 | 2 | — | 4 | 4 | 5 | 5 | — | 0.5 | 59 | 101 | 15 | 1 | 18000 |
| 14 | 3 | — | 2 | 5 | 5 | 5 | — | — | 62 | 105 | 2 | 15 | 8000 |
| 15 | — | 5 | 5 | — | 5 | 5 | — | — | 59 | 103 | 5 | 1 | 15000 |

The abbreviations in Table 1-1 are defined as follows.
BPA-EO: 2 mol ethylene oxide adduct on bisphenol A
BPA-PO: 2 mol propylene oxide adduct on bisphenol A
EG: ethylene glycol
NPG: neopentyl glycol
TPA: terephthalic acid
IPA: isophthalic acid
TMLA: trimellitic acid
BA: benzoic acid
Tg: glass transition temperature (unit: ° C.)
Tm: softening point (unit: ° C.)
AV: acid value (unit: mg KOH/g)
OHV: hydroxyl value (unit: mg KOH/g)
Mw: weight-average molecular weight

TABLE 1-2

| Binder resin | Styrene-acrylic resin composition: molar ratio | | | | Properties | | | | |
|---|---|---|---|---|---|---|---|---|---|
| No. | ST | BA | HEMA | MMA | Tg | Tm | AV | OHV | Mw |
| 9 | 6.3 | 2.1 | 1.6 | — | 60 | 100 | 17 | 8 | 19000 |
| 10 | 8.9 | — | — | 1.1 | 60 | 100 | 2 | 0 | 19000 |

The abbreviations in Table 1-2 are defined as follows.
ST: styrene
BA: butyl acrylate
HEMA: 2-hydroxyethyl methacrylate
MMA: methyl methacrylate
Tg: glass transition temperature (unit: ° C.)
Tm: softening point (unit: ° C.)
AV: acid value (unit: mg KOH/g)
OHV: hydroxyl value (unit: mg KOH/g)
Mw: weight-average molecular weight

Example 1

(Production of Liquid Developer 1: Wet Pulverization Method)

binder resin 1 25 parts
binder resin 2 38 parts
pigment (Pigment Blue 15:3) 9 parts
pigment dispersing agent (UR4800: Toyobo Co., Ltd.) 18 parts These materials were thoroughly mixed using a Henschel mixer followed by melt-kneading using a co-rotating twin-screw extruder with a roll internal heating temperature of 100° C.; the obtained mixture was cooled and coarsely pulverized to obtain a coarsely pulverized toner particle.

80 parts of Isopar D (ExxonMobil Corporation), 20 parts of the coarsely pulverized toner particle obtained as described above, and 4.5 parts of a toner particle dispersing agent (Ajisper PB-817, Ajinomoto Fine-Techno Co., Inc.) were then mixed for 24 hours using a sand mill to yield a toner particle dispersion 1.

The obtained toner particle dispersion 1 was subjected to centrifugal separation; the supernatant was removed by decantation and was replaced by fresh Isopar D in the same mass as the supernatant that had been removed; and redispersion was carried out.

0.10 parts of a hydrogenated lecithin (Lecinol S-10, Nikko Chemicals Co., Ltd.) as a charge control agent was then mixed to obtain a liquid developer 1.

Example 2

(Production of Liquid Developer 2: Coacervation Method)

pigment (Pigment Blue 15:3) 30 parts
pigment dispersing agent (UR4800: Toyobo Co., Ltd.) 47 parts
tetrahydrofuran 255 mass parts
glass beads (1 mm diameter) 130 parts These materials were mixed and then dispersed for 3 hours using an attritor (Nippon Coke & Engineering Co., Ltd.), followed by filtration on a mesh to obtain a pigment slurry.

pigment slurry 180 parts
50% tetrahydrofuran solution of binder resin 3 126 parts
50% tetrahydrofuran solution of binder resin 4 126 parts
toner particle dispersing agent 21 parts
(Ajisper PB-817, Ajinomoto Fine-Techno Co., Inc.)

These were mixed at 40° C. using a high-speed disperser (T. K. Robomix/T. K. Homodisper Model 2.5 impeller, PRIMIX Corporation) to obtain a pigment dispersion.

While stirring at high speed (rotation rate of 25,000 rpm) using a homogenizer (Ultra-Turrax T50, IKA), 100 parts of Isopar D (ExxonMobil Corporation) was added in small portions to 100 parts of the pigment dispersion to obtain a mixture.

The resulting mixture was transferred to a recovery flask and the tetrahydrofuran was completely distilled off at 50° C. using a rotary evaporator while performing ultrasound dispersion to obtain a toner particle dispersion 2.

10 parts of the obtained toner particle dispersion 2 was subjected to centrifugal separation; the supernatant was removed by decantation and was replaced by fresh Isopar D (ExxonMobil Corporation) in the same mass as the supernatant that had been removed; and redispersion was carried out.

0.10 parts of a hydrogenated lecithin (Lecinol S-10, Nikko Chemicals Co., Ltd.) as a charge control agent and 80.00 parts of Isopar D were then admixed to obtain a liquid developer 2.

Example 3

(Production of Liquid Developer 3: Wet Pulverization Method)

binder resin 5 38 parts binder resin 4 25 parts pigment (Pigment Blue 15:3) 9 parts pigment dispersing agent (UR4800: Toyobo Co., Ltd.) 18 parts Liquid developer 3 was obtained proceeding as in Example 1, but changing the composition of the coarsely pulverized toner particle to that given above.

Example 4

(Production of Liquid Developer 4: Wet Pulverization Method)

binder resin 3 31 parts binder resin 6 25 parts pigment (Pigment Blue 15:3) 9 parts pigment dispersing agent (UR4800: Toyobo Co., Ltd.) 18 parts Liquid developer 4 was obtained proceeding as in Example 1, but changing the composition of the coarsely pulverized toner particle to that given above.

Example 5

(Production of Liquid Developer 5: Wet Pulverization Method)

binder resin 3 31 parts binder resin 7 31 parts pigment (Pigment Blue 15:3) 9 parts pigment dispersing agent (UR4800: Toyobo Co., Ltd.) 18 parts Liquid developer 5 was obtained proceeding as in Example 1, but changing the composition of the coarsely pulverized toner particle to that given above.

Example 6

(Production of Liquid Developer 6: Wet Pulverization Method)

binder resin 8 31 parts binder resin 4 31 parts pigment (Pigment Blue 15:3) 9 parts pigment dispersing agent (UR4800: Toyobo Co., Ltd.) 18 parts Liquid developer 6 was obtained proceeding as in Example 1, but changing the composition of the coarsely pulverized toner particle to that given above.

Example 7

(Production of Liquid Developer 7: Wet Pulverization Method)

binder resin 9 38 parts binder resin 10 25 parts pigment (Pigment Blue 15:3) 9 parts pigment dispersing agent (UR4800: Toyobo Co., Ltd.) 18 parts Liquid developer 7 was obtained proceeding as in Example 1, but changing the composition of the coarsely pulverized toner particle to that given above.

Comparative Example 1

(Production of Liquid Developer 8: Wet Pulverization Method)

binder resin 11 38 parts binder resin 12 25 parts pigment (Pigment Blue 15:3) 9 parts pigment dispersing agent (UR4800: Toyobo Co., Ltd.) 18 parts Liquid developer 8 was obtained proceeding as in Example 1, but changing the composition of the coarsely pulverized toner particle to that given above.

Comparative Example 2

(Production of Liquid Developer 9: Wet Pulverization Method)

binder resin 13 63 parts pigment (Pigment Blue 15:3) 9 parts pigment dispersing agent (UR4800: Toyobo Co., Ltd.) 18 parts Liquid developer 9 was obtained proceeding as in Example 1, but changing the composition of the coarsely pulverized toner particle to that given above.

Comparative Example 3

(Production of Liquid Developer 10: Wet Pulverization Method)

binder resin 3 31 parts binder resin 14 31 parts pigment (Pigment Blue 15:3) 9 parts pigment dispersing agent (UR4800: Toyobo Co., Ltd.) 18 parts Liquid developer 10 was obtained proceeding as in Example 1, but changing the composition of the coarsely pulverized toner particle to that given above.

Comparative Example 4

(Production of Liquid Developer 11: Wet Pulverization Method)

binder resin 15 63 parts pigment (Pigment Blue 15:3) 9 parts pigment dispersing agent (UR4800: Toyobo Co., Ltd.) 18 parts Liquid developer 11 was obtained proceeding as in Example 1, but changing the composition of the coarsely pulverized toner particle to that given above.

Comparative Example 5

(Production of Liquid Developer 12: Wet Pulverization Method)

binder resin 3 31 parts binder resin 4 31 parts pigment (Pigment Blue 15:3) 9 parts pigment dispersing agent (UR4800: Toyobo Co., Ltd.) 18 parts A liquid developer 12 was obtained proceeding as in Example 1, but changing the composition of the coarsely pulverized toner particle to that given above and changing the 4.5 parts of the toner particle dispersing agent (Ajisper PB-817, Ajinomoto Fine-Techno Co., Inc.) to 5.5 parts of an amino group-free toner particle dispersing agent (Solsperse 3000: Lubrizol Japan Ltd.).

The composition and properties of the resulting liquid developers are given in Table 2.

In addition, the resulting liquid developers were evaluated using the following methods. The results of the evaluations are given in Table 3.

<Retention of the Volume Resistivity of the Liquid Developers>

The volume resistivity of the liquid developers was measured using an R8340A digital ultrahigh resistance/microcurrent meter (Advantest Corporation).

The measurement was run by introducing 25 mL of the liquid developer into an SME-8330 Liquid Sample Electrode (Hioki E.E. Corporation) and applying 1,000 V DC at a room temperature of 25° C.

First, the volume resistivity of the liquid developer was measured by the procedure described above to give the pre-holding volume resistivity.

The liquid developer was then held for one week in a 50° C. thermostat, after which time the post-holding volume resistivity was measured again using the procedure described above.

The volume resistivity retention ratio given by the following formula was calculated from the resulting pre-holding volume resistivity and post-holding volume resistivity and was evaluated.

volume resistivity retention ratio=(post-holding volume resistivity/pre-holding volume resistivity)×100

(Evaluation Criteria)

A: the retention ratio is equal to or greater than 90.0%

B: the retention ratio is equal to or greater than 80.0% and less than 90.0%

C: the retention ratio is equal to or greater than 60.0% and less than 80.0%

D: the retention ratio is less than 60.0%

<Fixing Performance>

The liquid developer was coated (thickness of 8 μm) at 25° C. with a wire bar (No. 6) on a polyethylene terephthalate film, and fixing was performed by the application of heat and pressure under conditions of 160° C. and a speed of 30 m/min. The presence/absence of surface tack (stickiness) was scored by contacting the film surface with a finger immediately after the application of heat and pressure.

(Evaluation Criteria)

3: Absolutely no tack is recognized.

2: Slight tack is recognized.

1: The film detaches upon contact with a finger, or has not been cured.

<Toner Particle Dispersion Stability>

The 50% particle diameter on a volume basis (D50) of the toner particles in the obtained liquid developer was measured using a laser diffraction/scattering particle size distribution analyzer (LA-950, Horiba, Ltd.) to obtain the pre-holding (D50).

The liquid developer was then held for one week in a 50° C. thermostat, after which time the 50% particle diameter on a volume basis (D50) of the toner particles in the liquid developer was again measured using the aforementioned procedure to obtain the post-holding (D50).

The toner particle dispersion stability was evaluated using the post-versus-pre-holding toner particle D50 ratio (post-holding D50/pre-holding D50).

(Evaluation Criteria)

3: (post-versus-pre-holding D50 ratio)≤1.1

2: 1.1<(post-versus-pre-holding D50 ratio)≤1.3

1: 1.3<(post-versus-pre-holding D50 ratio)

TABLE 2

| | Liquid developer No. | Binder resin No. | | Mw of binder resin | *1 | *2 | *3 | *4 | *5 |
|---|---|---|---|---|---|---|---|---|---|
| Example 1 | 1 | 1 | 2 | 14700 | 20 | 0 | 1 | 21 | PB817 |
| Example 2 | 2 | 3 | 4 | 13100 | 15 | 1 | 1 | 16 | PB817 |
| Example 3 | 3 | 4 | 5 | 15300 | 10 | 1 | 1 | 11 | PB817 |
| Example 4 | 4 | 3 | 6 | 13500 | 15 | 5 | 1 | 16 | PB817 |
| Example 5 | 5 | 3 | 7 | 13000 | 15 | 1 | 10 | 16 | PB817 |
| Example 6 | 6 | 4 | 8 | 15200 | 13 | 1 | 1 | 14 | PB817 |
| Example 7 | 7 | 9 | 10 | 19000 | 16 | 3 | 5 | 17 | PB817 |
| Comparative Example 1 | 8 | 11 | 12 | 16500 | 9 | 3 | 1 | 9 | PB817 |
| Comparative Example 2 | 9 | 13 | | 18000 | 15 | 15 | 1 | 15 | PB817 |
| Comparative Example 3 | 10 | 3 | 14 | 12900 | 15 | 3 | 12 | 16 | PB817 |
| Comparative Example 4 | 11 | 15 | | 15100 | 5 | 5 | 1 | 5 | PB817 |
| Comparative Example 5 | 12 | 3 | 4 | 13100 | 15 | 1 | 1 | 16 | S3000 |

*1: Acid value of binder resin (mg KOH/g)

*2: Acid value of component having a molecular weight of not more than 2,000

*3: Hydroxyl value of component having a molecular weight of not more than 2,000

*4: Acid value of component having a molecular weight from 10,000 to 40,000

*5: Type of toner particle dispersing agent

With regard to the type of toner particle dispersing agent in Table 2,

PB817 indicates Ajisper PB-817 (primary amine: reaction product of a polyallylamine with a self-condensate of 12-hydroxystearic acid, Ajinomoto Fine-Techno Co., Inc.), and S3000 indicates Solsperse 3000 (acidic dispersing agent (non-amine type), Lubrizol Japan Ltd.).

TABLE 3

| | Liquid developer No. | Retention ratio for volume resistivity: Pre-holding ($\times 10^{10}$ $\Omega \cdot$ cm) | Post-holding ($\times 10^{10}$ $\Omega \cdot$ cm) | Retention ratio (%) | Evaluation |
|---|---|---|---|---|---|
| Example 1 | 1 | 5.00 | 5.10 | 102.0 | A |
| Example 2 | 2 | 4.80 | 4.80 | 100.0 | A |
| Example 3 | 3 | 4.80 | 4.30 | 89.6 | B |
| Example 4 | 4 | 4.90 | 4.40 | 89.8 | B |
| Example 5 | 5 | 4.80 | 4.30 | 89.6 | B |
| Example 6 | 6 | 4.90 | 3.90 | 79.6 | C |
| Example 7 | 7 | 4.90 | 4.40 | 89.8 | B |
| Comparative Example 1 | 8 | 2.10 | 0.92 | 43.8 | D |
| Comparative Example 2 | 9 | 4.50 | 1.20 | 26.7 | D |
| Comparative Example 3 | 10 | 4.50 | 0.20 | 4.4 | D |
| Comparative Example 4 | 11 | 3.00 | 0.45 | 15.0 | D |
| Comparative Example 5 | 12 | 5.50 | 5.50 | 100.0 | A |

| | Liquid developer No. | Fixing performance evaluation | Toner particle dispersion stability: Pre-holding (D50:μm) | Post-holding (D50:μm) | D50 ratio | Evaluation |
|---|---|---|---|---|---|---|
| Example 1 | 1 | 3 | 0.80 | 0.79 | 1.0 | 3 |
| Example 2 | 2 | 3 | 0.77 | 0.77 | 1.0 | 3 |
| Example 3 | 3 | 3 | 0.81 | 0.81 | 1.0 | 3 |
| Example 4 | 4 | 3 | 0.78 | 0.77 | 1.0 | 3 |
| Example 5 | 5 | 3 | 0.80 | 0.81 | 1.0 | 3 |
| Example 6 | 6 | 3 | 0.79 | 0.80 | 1.0 | 3 |
| Example 7 | 7 | 3 | 0.82 | 0.81 | 1.0 | 3 |
| Comparative Example 1 | 8 | 3 | 0.81 | 0.80 | 1.0 | 3 |
| Comparative Example 2 | 9 | 3 | 0.77 | 0.78 | 1.0 | 3 |
| Comparative Example 3 | 10 | 3 | 0.80 | 0.79 | 1.0 | 3 |
| Comparative Example 4 | 11 | 3 | 0.78 | 0.78 | 1.0 | 3 |
| Comparative Example 5 | 12 | 3 | 0.79 | 1.13 | 1.4 | 1 |

According to the present invention, a liquid developer that exhibits an excellent toner particle dispersion stability and a suppression of the reduction in volume resistivity due to elapsed time can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A liquid developer, comprising:

a toner particle containing binder resin having an acid value of 20 to 50 mg KOH/g;

a carrier liquid which is a normal-paraffin solvent or an isoparaffin solvent; and a basic toner particle dispersing agent, said basic toner particle dispersing agent being a primary amine, wherein a first component of the binder resin has an acid value of 0 mg KOH/g and a hydroxyl value of not more than 10 mg KOH/g, the first component being present in a chloroform soluble component fraction of the binder resin having a molecular weight of not more than 2,000 as determined by GPC, and a second component of the binder resin has an acid value of 21 to 50 mg KOH/g, the second component being present in a chloroform soluble component fraction of the binder resin having a molecular weight of 10,000 to 40,000 as determined by GPC.

2. The liquid developer according to claim 1, wherein the binder resin is a polyester resin.

3. The liquid developer according to claim 1, wherein the binder resin is a mixture of (i) a resin A having a weight-average molecular weight of 12,000 to 60,000 and an acid value of at least 15 mg KOH/g, and (ii) a resin B having a weight-average molecular weight of 1,000 to 12,000, an acid value of not more than 5 mg KOH/g and a hydroxyl value of not more than 10 mg KOH/g.

4. The liquid developer according to claim 1, wherein the toner particle further comprises a pigment, and a pigment dispersing agent.

5. The liquid developer according to claim 4, wherein the pigment dispersing agent comprises 1 to 100 mass parts per 100 mass parts of the pigment in the toner particle.

* * * * *